US006766529B1

(12) United States Patent
Nathan

(10) Patent No.: US 6,766,529 B1
(45) Date of Patent: Jul. 27, 2004

(54) BODY ARMOR CARRIER COMPRESSION SHIRT

(76) Inventor: Efraim Nathan, 401 W. Walnut St., Perkasie, PA (US) 18944

( * ) Notice: Subject to any disclaimer, the term of this patent is extended or adjusted under 35 U.S.C. 154(b) by 0 days.

(21) Appl. No.: 10/436,794

(22) Filed: May 13, 2003

Related U.S. Application Data

(60) Provisional application No. 60/380,377, filed on May 13, 2002.

(51) Int. Cl.[7] ..... F41H 1/02

(52) U.S. Cl. ..... 2/2.5; 2/115

(58) Field of Search ..... 2/2.5, 115, 92, 2/95, 94, 102, 463, 467, 455, 69, 49.4, 49.5; 89/36.01, 36.02; 428/911

(56) References Cited

U.S. PATENT DOCUMENTS 1,574,188 A * 2/1926 Friedman ..... 428/102
1,739,112 A * 12/1929 Wisbrod ..... 2/2.5
2,316,055 A * 4/1943 Davey ..... 89/36.05
2,424,985 A * 8/1947 Howard ..... 2/2.5
3,135,961 A * 6/1964 Roderick ..... 2/463
3,855,632 A * 12/1974 Davis ..... 2/2.5
4,535,478 A * 8/1985 Zufle ..... 2/2.5
5,157,792 A * 10/1992 Allen et al. ..... 2/2.5

* cited by examiner

*Primary Examiner*—Tejash Patel
(74) *Attorney, Agent, or Firm*—Norman E. Lehrer

(57) ABSTRACT

A garment for carrying body armor including a shirt body having a front portion, a rear portion, and a neck portion is disclosed. A plurality of pockets is formed on the front portion where the plurality of pockets is stacked upon each other. A pocket is also formed in the rear portion. At least one body armor insert is positioned within each of the pockets. The plurality of pockets includes a first panel, a second panel, and a third panel. The first panel is secured to the front portion of the shirt body in order to form a first pocket, the second panel is secured to the first panel in order to form a second pocket, and the third panel is secured to the second panel in order to form a third pocket. The first panel is removably fastened to the shirt body via complementary hook and loop fasteners.

7 Claims, 4 Drawing Sheets

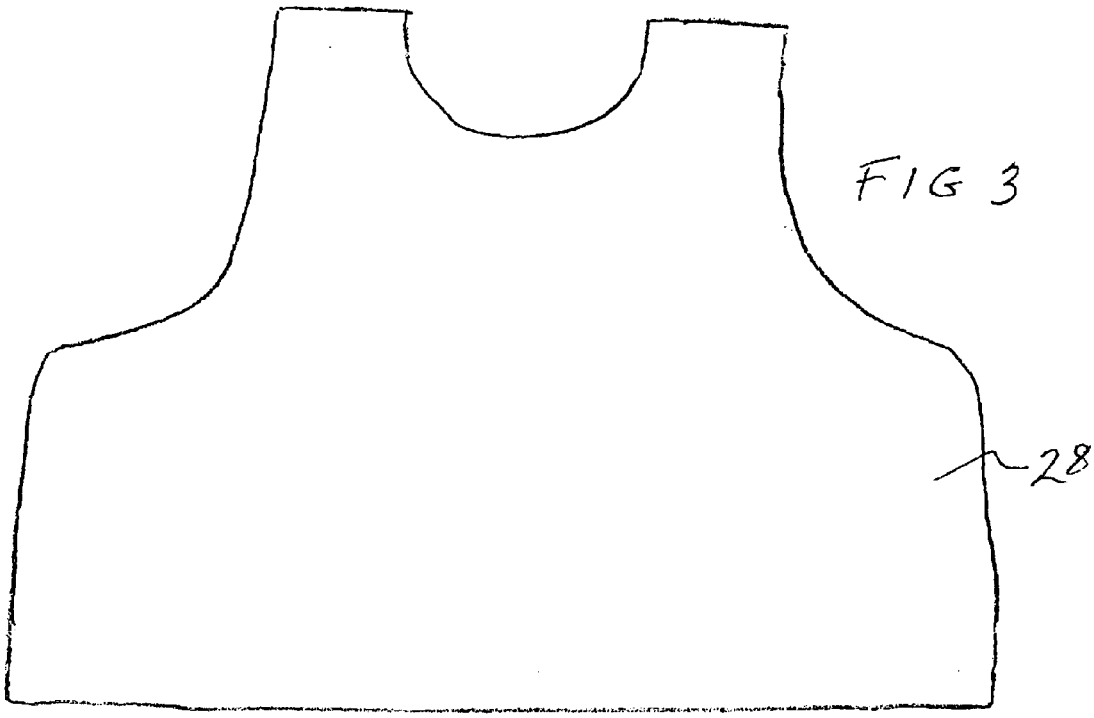
FIG 3
FIG 4
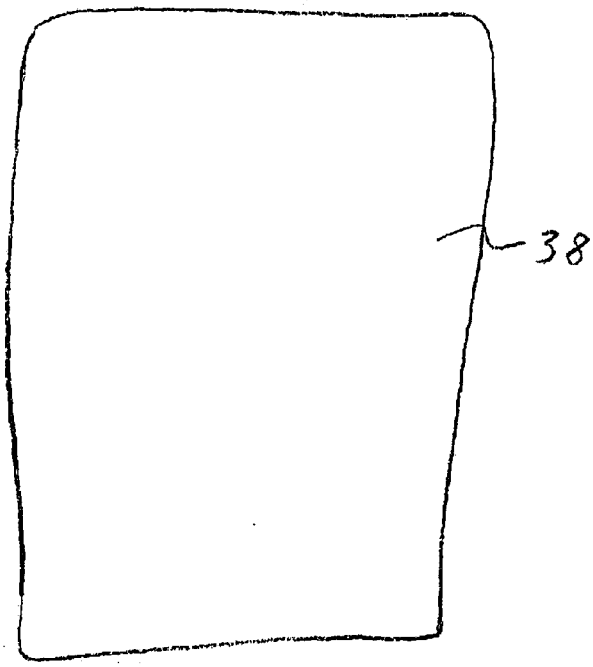
FIG 5
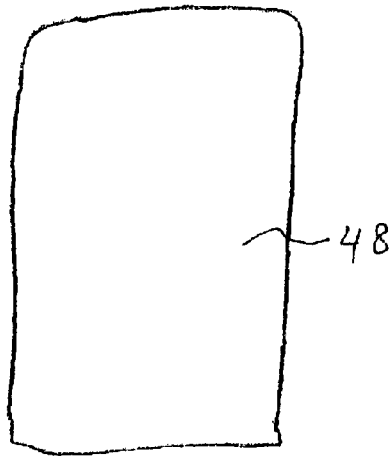

BODY ARMOR CARRIER COMPRESSION SHIRT

CROSS-REFERENCE TO RELATED APPLICATION

This application claims the benefit of U.S. Provisional Patent Application Ser. No. 60/380,377 filed May 13, 2002.

BACKGROUND OF THE INVENTION

The present invention relates generally to ballistic resistant or bulletproof garments and, more particularly, to a garment designed to carry body armor.

Body armor having hard and soft construction is known and has been incorporated into various types of garments. Such garments are used to provide protection from blunt action trauma and/or penetrating injuries from projectiles. Conventional garments, however, tend to be bulky and uncomfortable to wear, and tend to restrict a user's movement. A need exists for a bulletproof garment that is effective, flexible and comfortable to use, and which exhibits additional functional advantages compared to known garments.

SUMMARY OF THE INVENTION

The present invention is designed to overcome the deficiencies of the prior art discussed above. It is an object of the present invention to provide a garment for carrying body armor that is comfortable to wear and reduces muscle fatigue of the wearer.

It is another object of the present invention to provide a garment for carrying body armor where the body armor is removably positioned within the garment.

In accordance with the illustrative embodiments demonstrating features and advantages of the present invention, there is provided a garment for carrying body armor including a shirt body having a front portion, a rear portion, and a neck portion. A plurality of pockets is formed on the front portion where the plurality of pockets is stacked upon each other. A pocket is also formed in the rear portion. At least one body armor insert is positioned within each of the pockets. The plurality of pockets includes a first panel, a second panel, and a third panel. The first panel is secured to the front portion of the shirt body in order to form a first pocket, the second panel is secured to the first panel in order to form a second pocket, and the third panel is secured to the second panel in order to form a third pocket. The first panel is removably fastened to the shirt body via complementary hook and loop fasteners secured to the first panel and to the front portion of the shirt body. The pocket formed in the rear portion of the shirt body includes a rear panel secured to the rear portion of the shirt body. The rear panel is removably fastened to the shirt body via complementary hook and loop fasteners secured to the rear panel and to the rear portion of the shirt body. The panels and shirt body are made from a combination of stretch fabric and high performance fabric thereby making the garment comfortable to wear and reducing muscle fatigue of the wearer.

Other objects, features, and advantages of the invention will be readily apparent from the following detailed description of a preferred embodiment thereof taken in conjunction with the drawings.

Brief Description of the Drawings

The following detailed description of preferred embodiments of the invention will be better understood when read in conjunction with the appended drawings. For the purpose of illustrating the invention, the presently preferred embodiments are shown in the drawings. It should be understood, however, that the invention is not limited to the precise arrangements and instrumentalities shown.

In the drawings:

FIG. 3 is a plan view of the body armor insert that fits within the first pocket of the garment of the present invention;

FIG. 4 is a plan view of the body armor insert that fits within the second pocket of the garment of the present invention;

FIG. 5 is a plan view of the body armor insert that fits within the third pocket of the garment of the present invention.

DETAILED DESCRIPTION OF THE PREFERRED EMBODIMENT

Figure 1:
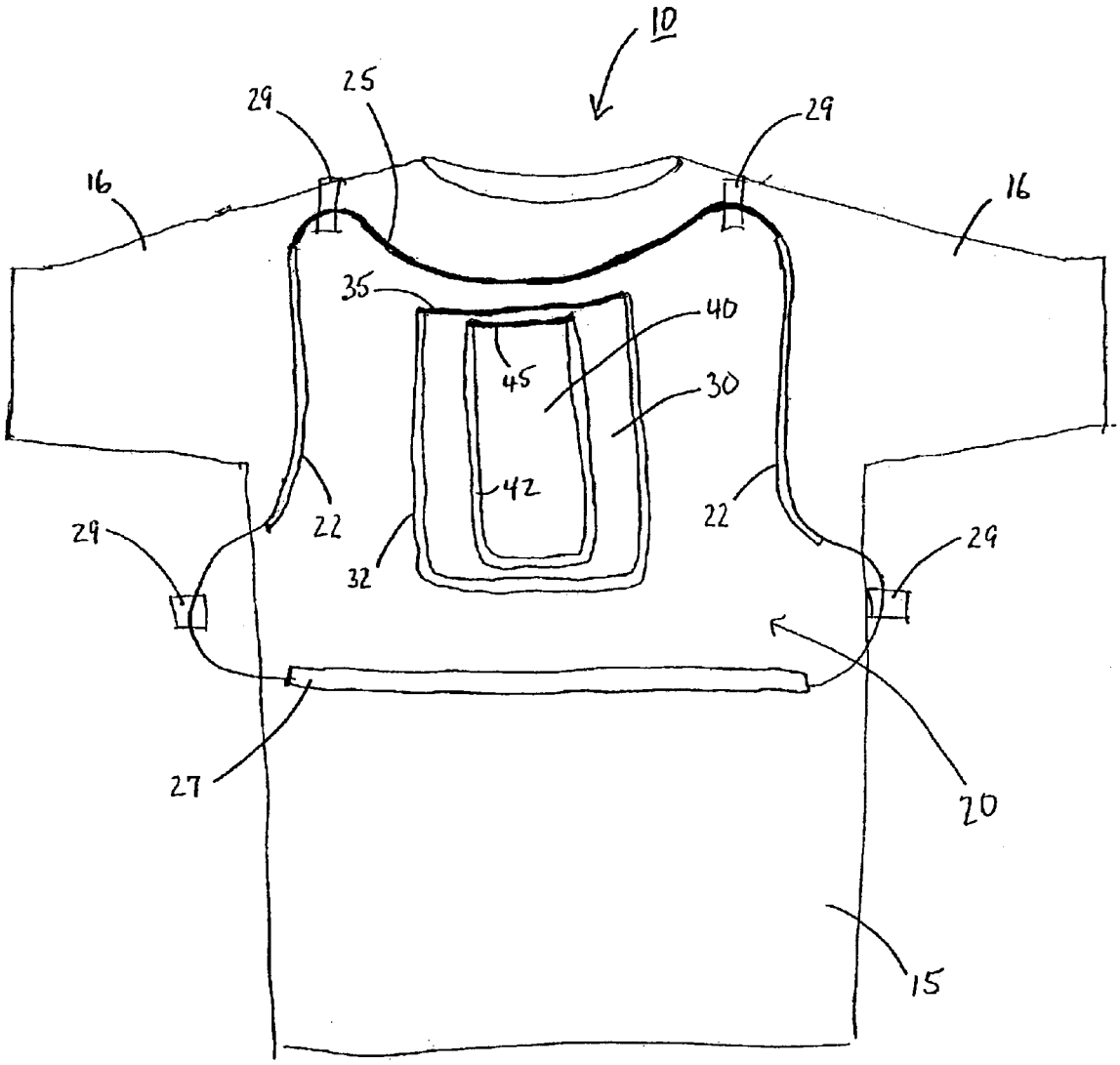
FIG. 1 is a front view of a garment according to one embodiment of the present invention.
Figure 2:
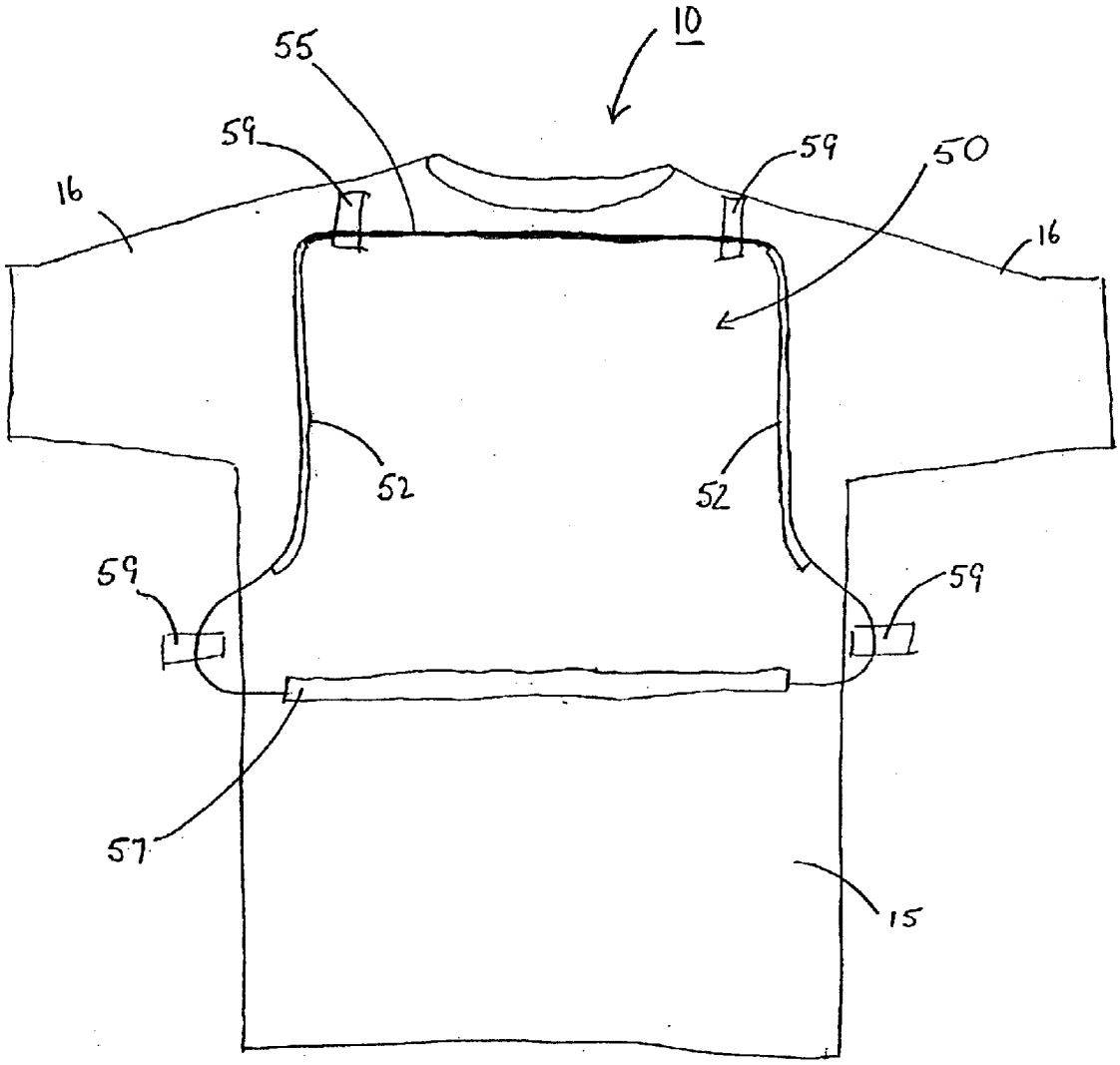
FIG. 2 is a rear view of the embodiment shown in FIG. 1.

Referring to FIGS. 1 and 2, an exemplary preferred embodiment of the body armor carrier compression shirt 10 of the present invention is disclosed. The shirt 10 comprises a shirt body 15 having sleeves 16, a plurality of front and rear panels 20, 30,40 and 50, and a plurality of fasteners 29, 59. The shirt body 15 and the panels 20, 30, 40 and 50 are preferably made from stretch fabrics such as DuPont LYCRA® SPANDEX or the like.

It will be appreciated by those skilled in the art that the shirt 10 may be modified to include, for example, long sleeves, a collar or the like, or the exclude sleeves. The shirt body 15 can be manufactured from one or more components, including, for example, a front portion with an outer surface, a back portions, a sleeve portion, and a neck portion. The front panels may be secured to the outer surface of the portion of the shirt body. The components may be assembled and/or fastened together using any known techniques such as sewing or the like.

As seen in FIG. 1, a third front panel 40 is attached to a second front panel 30 which is then attached to a first front panel 20 which is then attached to the shirt body 15 thereby producing a stacked or layered appearance. The first front panel 20 is attached to the shirt body 15 along seams 22 and 27 so as to define a pocket having openings between the seams. The pocket is adapted to receive one or more body armor insert panels and/or trauma plates, shown for example as 28 in FIG. 3. One or more fasteners 29 are preferably attached to the first front panel 20 between the seams 22, 27 to provide a means for closing the openings and/or adjusting the fit of the garment. The fasteners 29 can be any type of fastener commonly known or used, including, for example, VELCRO®.

The second front panel 30 is preferably attached to the first front panel 20 along seam 32 so as to define a second pocket. The second pocket has an opening for receiving one or more additional body armor insert panels and/or trauma plates, shown for example as 38 in FIG. 4. The second front panel 30 is preferably positioned to provide added protection for vital organs from blunt action trauma.

The third front panel 40 is preferably attached to the second front panel 30 along seam 42 so as to define a third pocket. The third pocket has an opening for receiving one or more additional body armor insert panels and/or trauma plates, shown for example as 48 in FIG. 5. The third front panel 30 is preferably positioned to provide added protection for vital organs from blunt action trauma.

Figure 6:
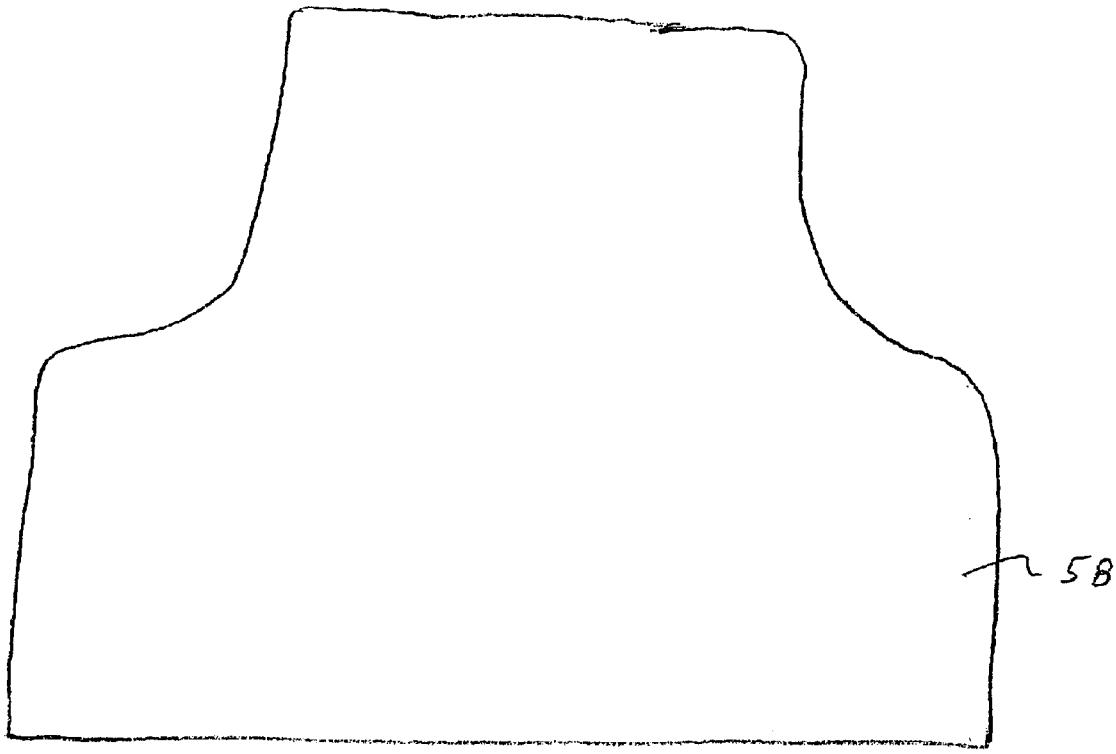
FIG. 6 is a plan view of the body armor insert that fits within the pocket formed in the rear portion of the garment of the present invention

As seen in FIG. 2, a rear panel 50 is attached to the rear portion 17 of the shirt body 15 along seams 52 and 57 so as to define a pocket having openings between the seams 52, 57. The pocket is adapted to receive one or more body armor insert panels and/or trauma plates shown for example as 58 in FIG. 6. One or more fasteners 59 are preferably attached to the rear panel 50 between the seams 52, 57 to provide a means for closing the openings and/or adjusting the fit of the garment. The fasteners 59 can be any type of fastener commonly known or used including, for example, VELCRO®.

Preferably, the top edges 25, 35, 45 and 55 of the panels 20, 30, 40 and 50 are hemmed with elastic (e.g. ⅜ inch) to provide improved fit and durability. The bottom edges of the first front panel 20 and the rear panel 50 are preferably attached to the shirt body 15 using elastic (e.g. ⅝ inch band).

It will be appreciated by those skilled in the art that the exemplary embodiment shown in FIGS. 1–2 and discussed above can be modified to change the length and position of the seams 22, 27, 52 and 57. It will be further understood that the size, shape, position and number of panels 20, 30, 40 and 50 can be modified to provide more or less coverage, protection and/or flexibility.

The panels 20, 30, 40 and 50 are preferably sized to form pockets for receiving standard size removable body armor insert panels and trauma plates. The use of removable panels provides the additional benefit of being able to use the body armor insert panels and trauma plates on a day-today basis by transferring the panels and plates to another carrier garment while one is being washed or laundered.

The shirt 10 of the present invention may be used in any application where a user would benefit from protection from blunt action trauma and/or penetrating injuries such as sporting activities including but not limited to baseball, football, paintball, fencing, hunting or the like.

The use of the stretch fabric in shirt 10 provides an additional benefit of having the garment fit snugly against the wearer's body to provide reduced irritation from chaffing, reduced muscle vibration and muscle fatigue, reduced injury from chronic conditions such as tendonitis and bursitis, and greater overall comfort.

Additionally, the use of stretch fabric allows the use of body armor or trauma plate inserts shaped to closely conform to either the male or female form, thus providing a more comfortable fit and better concealment of the bulletproof garment under other clothing.

Since body armor can become particularly uncomfortable in warm weather conditions or in situations involving extended physical activity, the shirt 10 preferably includes high performance fibers/fabrics such as DuPont COOLMAX® and DuPont LYCRA®. Alternatively, the shirt 10 can include nylon, cotton or any other material commonly found in garments or any combination thereof. COOLMAX® fabrics are designed to move moisture away from the body to the outer layers of the fabric where it dries faster and is thus more comfortable. LYCRA® fabrics provide high stretch and high compression to reduce muscle vibration which causes muscle fatigue.

More preferably, the shirt 10 comprises 70% DuPont COOLMAX® and 30% DuPont LYCRA®. This combination of high performance fibers/fabrics has been proven to reduce muscle vibration, greatly reducing muscle fatigue. Reduction in muscle fatigue allows the body to perform at a higher level for a longer period of time relative to unstablized muscles of a user wearing known body armor carrier garments.

The body armor insert panels or trauma plates 28, 38, 48 and 58 are preferably made from a relatively flexible material such as KEVLAR® or the like. While it might be possible to use a more rigid material, the flexible material is easier to insert into the pockets. Furthermore, the use of flexible material for the trauma plates makes the entire shirt 10 more flexible and comfortable to wear as more fully described herein.

The shirt 10 of the present invention also provides improved proprioception (or joint position sense) due to the sensory feedback from the skin and, to some degree, from the resistive force encountered as the fabric is stretched during limb placement.

The shirt 10 also provides an improved "mechanical spring" effect in that when the fabric of the shirt 10 is elongated (equivalent to compressing a spring) as a user's body flexes, and as the fabric recovers (equivalent to the recoil of the spring) the recovery force from the fabric provides "extra lift" thereby increasing the force of the user.

The shirt 10 also enables improved cardiovascular performance of a user by providing compression which increases blood return to the heart allowing improved oxygen transport, improved physical efficiency, reduced fatigue and reduced lactic acid production in muscle tissue which contributes to muscle stiffness/soreness after physical activity.

The shirt 10 also facilitates recovery of damages muscles by providing reduced swelling through compression. Compression and reduced swelling improves blood flow to damaged muscle tissue allowing more oxygen to get to the damaged muscle tissue which leads to more efficient and quicker healing.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

I claim:

1. A garment for carrying body armor comprising:

a shirt body having a front portion with an outer surface, a rear portion, and a neck portion;

a plurality of pockets formed on said outer surface of said front portion, said plurality of pockets being stacked upon each other, said plurality of pockets including a first panel, a second panel, and a third panel, said first panel being secured to said front portion of said shirt body in order to form a first pocket, said second panel being secured to said first panel in order to form a second pocket, and said third panel being secured to said second panel in order to form a third pocket, said first panel being removably fastened to said shirt body;

a pocket formed in said rear portion; and a plurality of body armor inserts wherein at least one of said inserts is positioned within each of said pockets.

2. The garment of claim 1 wherein complementary hook and loop fasteners are secured to said first panel and said outer surface of said front portion of said shirt body so that said first panel is removably fastened to said shirt body.

3. The garment of claim 1 wherein said shirt body and said panels are made from a combination of stretch fabric and high performance fabric.

4. The garment of claim 1 wherein said pocket formed in said rear portion of said shirt body includes a rear panel secured to said rear portion of said shirt body.

5. The garment of claim 4 wherein said rear panel is removably fastened to said shirt body.

6. The garment of claim 5 wherein complementary hook and loop fasteners are secured to said rear panel and said rear portion of said shirt body so that said rear panel is removably fastened to said shirt body.

7. The garment of claim 4 wherein said shirt body and said rear panel are made from a combination of stretch fabric and high performance fabric.

* * * * *